US011946350B2

(12) United States Patent
Bai et al.

(10) Patent No.: US 11,946,350 B2
(45) Date of Patent: Apr. 2, 2024

(54) METHOD FOR REMOTELY SHUTTING DOWN DOWNHOLE UNIT OF ROTARY STEERING SYSTEM FROM GROUND

(71) Applicants: CHINA NATIONAL PETROLEUM CORPORATION, Beijing (CN); CNPC CHUANQING DRILLING ENGINEERING COMPANY LIMITED, Sichuan (CN)

(72) Inventors: Jing Bai, Sichuan (CN); Jichuan Zhang, Sichuan (CN); Dengyun Lu, Sichuan (CN); Lei Li, Sichuan (CN); Chongjun Huang, Sichuan (CN); Lichun Jia, Sichuan (CN); Chong Liao, Sichuan (CN); Liexiang Han, Sichuan (CN); Dejun Zhang, Sichuan (CN); Gui Tang, Sichuan (CN)

(73) Assignees: CHINA NATIONAL PETROLEUM CORPORATION, Beijing (CN); CNPC CHUANQING DRILLING ENGINEERING COMPANY LIMITED, Sichuan (CN)

( * ) Notice: Subject to any disclaimer, the term of this patent is extended or adjusted under 35 U.S.C. 154(b) by 2 days.

(21) Appl. No.: 17/925,599

(22) PCT Filed: May 25, 2021

(86) PCT No.: PCT/CN2021/095724
§ 371 (c)(1),
(2) Date: Nov. 15, 2022

(87) PCT Pub. No.: WO2021/238898
PCT Pub. Date: Dec. 2, 2021

(65) Prior Publication Data

US 2023/0193729 A1 Jun. 22, 2023

(30) Foreign Application Priority Data

May 29, 2020 (CN) ..... 202010472068.5

(51) Int. Cl.
*E21B 21/08* (2006.01)
*E21B 34/06* (2006.01)
*E21B 43/12* (2006.01)
*E21B 47/18* (2012.01)

(52) U.S. Cl.
CPC ..... *E21B 43/126* (2013.01); *E21B 34/066* (2013.01); *E21B 47/18* (2013.01)

(58) Field of Classification Search
CPC ..... E21B 43/126; E21B 43/13; E21B 21/08; E21B 21/082; E21B 21/085; E21B 21/00
See application file for complete search history.

(56) References Cited

U.S. PATENT DOCUMENTS 9,926,776 B2 * 3/2018 Zha ..... E21B 44/00
2020/0398312 A1 * 12/2020 Cady ..... E21B 21/065

* cited by examiner

*Primary Examiner* — Catherine Loikith

(57) ABSTRACT

A method for remotely shutting down a downhole unit of a rotary steering system from ground includes steps of: a: calculating a pressure difference $P_1$ between a front end and a rear end of the drill water hole; b: calculating an extension loss $\Delta P$; c: calculating a pressure $P_2$ at the riser after turning on the downlink device; d: calculating an opening area $S_1$ of the throttle valve of the downlink device; and e: adjusting the throttle valve to a calculated opening degree; automatically targeting the function block that needs to be cut off according to a flow change detected downhole, and shutting down the downhole unit. The method can realize self-protection and continuous operation of the entire rotary steering system, reduce frequency of inspection that needs to pull back the drill when the rotary steering system is abnormal, improve drilling efficiency, and reduce costs.

14 Claims, No Drawings

METHOD FOR REMOTELY SHUTTING DOWN DOWNHOLE UNIT OF ROTARY STEERING SYSTEM FROM GROUND

BACKGROUND OF THE PRESENT INVENTION

Field of Invention

The present invention relates to a technical field of oil drilling, and more particularly to a method for remotely shutting down a downhole unit of a rotary steering system from ground.

Description of Related Arts

The downlink device of the rotary steering system is the key component to control downhole from the ground. The implementation principle is that the mud displacement entering the well can be changed by diverting a certain proportion of drilling fluid in the riser, thereby sending ground command to the downhole rotary steering tool. Since the rotary steering tool is energized by a turbine generator, the mud displacement entering the well cannot be too small, otherwise the downhole energy supply will be affected. Therefore, the diverting flow of the downlink device needs to be precisely controlled, which is conventionally adjusted by experience, leading to problems such as long adjustment time and low precision, thus lowering the time-effectiveness of command issuance.

Chinese patent CN 203603892U, published on May 21, 2014, disclosed a semi-automatic ground control device and a signal analysis system for a rotary steering system, including the ground control device and the signal analysis system. The ground control device includes a riser from which a diverting pipeline is extended. A stop valve, an on-off valve, a flow regulating valve and a flowmeter are installed in sequence in the diverting pipeline. The stop valve is used to open or close the diverting pipeline. The on-off valve is connected to a pneumatic control mechanism, the pneumatic control mechanism is connected to a PLC controller, and the PLC controller is connected to a computer. The PLC controller is used to control the action of the pneumatic control mechanism. The flow regulating valve is used to adjust the flow rate passing through the valve. The signal analysis system is used to receive and analyze a negative pulse signal generated by opening and closing the on-off valve.

The semi-automatic ground control device and the signal analysis system for the rotary steering system disclosed in the above patent can control the flow continuously and uninterruptedly, which is suitable for the harsh environment with fire and explosion, and has no jamming. However, when error occurs, it is necessary to pull back the drill for inspection, so it is impossible for the rotary steering system to perform self-protection and continuous operation, which affects the time-effectiveness of drilling operations.

SUMMARY OF THE PRESENT INVENTION

To overcome the above-mentioned defects of the prior art, the present invention provides a method for remotely shutting down a downhole unit of a rotary steering system from ground. When error occurs in any function block, the present invention can adjust a diverting flow of a downlink device according to a preset corresponding relationship between the function block and the diverting flow, and automatically target the function block that needs to be cut off, so as to realize self-protection and continuous operation of the entire rotary steering system, reduce frequency of inspection that needs to pull back the drill when the rotary steering system is abnormal, improve drilling efficiency, and reduce costs.

Accordingly, in order to accomplish the above object, the present invention provides:

a method for remotely shutting down a downhole unit of a rotary steering system from ground, comprising steps of:

a: setting a diversion ratio of a downlink device as k, an equivalent area of a drill water hole as s, a total displacement of a mud pump as Q, and a pressure of a riser before the downlink device is turned on as P; calculating a pressure difference $P_1$ between a front end and a rear end of the drill water hole by a formula 1;

$$P_1=Q^2\rho/2\mu^2s^2 \quad \text{formula 1;}$$

wherein Q is the total displacement of the mud pump, $m^2/s$; μ is a flow coefficient and μ=0.63; s is the equivalent area of the drill water hole, $m^2$; $P_1$ is the pressure difference between the front end and the rear end of the drill water hole, Pa; and ρ is fluid density, $Kg/m^3$;

b: calculating an extension loss ΔP by a formula 2;

$$\Delta P=P-P_1 \quad \text{formula 2;}$$

c: calculating a pressure $P_2$ at the riser after turning on the downlink device by a formula 3;

$$P_2=\Delta P+\rho(1-k)^2Q^2/2\mu^2s^2 \quad \text{formula 3;}$$

d: since a pressure drop of a throttle valve of the downlink device is also $P_2$ according to a pressure balance relationship, calculating an opening area $S_1$ of the throttle valve of the downlink device by a formula 4;

$$S_1 = kQ/\sqrt[\mu]{2P_2/\rho}; \quad \text{formula 4}$$

and e: adjusting the throttle valve to a calculated opening degree according to a relationship between the opening degree and the opening area $S_1$ of the throttle valve, so that a diverting flow automatically reaches the set diversion ratio; providing a cut-off circuit to each function block of the rotary steering system; numbering each function block, and forming a preset corresponding relationship between the function block and the diverting flow of the downlink device, which is solidified in a rotary steering tool control software; if any function block is abnormal, adjusting the diverting flow of the downlink device according to the preset corresponding relationship between the function block and the diverting flow; automatically targeting the function block that needs to be cut off according to a flow change detected downhole, and shutting down the downhole unit.

In the step e, adjusting the throttle valve to the calculated opening degree comprises specific steps of: calibrating indoors to form a relationship curve between the opening degree and the opening area; and obtaining a required opening degree based on the relationship curve between the opening degree and the opening area, as well as a required opening area of the throttle valve area corresponding to the diversion ratio set in the previous step.

In the step e, the diverting flow automatically reaches the set diversion ratio through specific steps of: after the downlink device receives the set diversion ratio, calculating a required opening area of the throttle valve of the downlink device according to a calculation formula, and then obtaining a required opening degree of the throttle valve according to the relationship between the opening degree and the opening area $S_1$ of the throttle valve; according to a corresponding relationship between the required opening degree of the throttle valve and an analog electrical signal, outputting a current signal, so as to reach the set diversion ratio through automatic adjustment of the throttle valve of the downlink device.

In the step e, forming the preset corresponding relationship between the function block and the diverting flow comprises specific steps of: presetting 9 function blocks, and installing a controllable diode on each of the 9 function blocks; using three flows of 10%, 15% and 20% with different durations to represent the 9 function blocks; wherein the 10% diverting flow lasting for 2 s means to shut down a 1 # function block; the 10% diverting flow lasting for 4 s means to shut down a 2 # function block; the 10% diverting flow lasting for 6 s means to shut down a 3 # function block; the 15% diverting flow lasting for 2 s means to shut down a 4 # function block; the 15% diverting flow lasting for 4 s means to shut down a 5 # function block; the 15% diverting flow lasting for 6 s means to shut down a 6 # function block; the 20% diverting flow lasting for 2 s means to shut down a 7 # function block; the 20% diverting flow lasting for 4 s means to shut down a 8 # function block; and the 20% diverting flow lasting for 6 s means to shut down a 9 # function block.

In the step e, shutting down the downhole unit comprises specific steps of: since the rotary steering system comprises a downhole mud turbine generator and a voltage frequency changes accordingly when a mud flow through the downhole mud turbine generator changes, detecting a voltage frequency change by a rotary steering control module, so as to obtain a mud flow change; detecting a size of the diverting flow downhole and combining with an inherent coding method to complete identification of a downlink command; after receiving a shutdown command, setting a controllable diode of a corresponding function block to a cut-off state.

Basic principle of the present invention is as follows:

The downlink device of the rotary steering system is a component that realizes the ground control of the downhole rotary steering tool. The mud displacement entering the well can be changed by diverting a certain proportion of drilling fluid in the riser, thereby sending ground command to the downhole rotary steering tool. The front end of the throttle valve and the riser are the same pressure system, sharing the same pressure. Based on the pressure balance and the relationship between flow and pressure, it can be assumed that the diversion ratio of the downlink device is k, the equivalent area of the drill water hole is s, the total discharge of the mud pump is Q, and the pressure of the riser before the downlink device is turned on is P. The pressure difference $P_1$ between the front end and the rear end of the drill water hole, the extension loss $\Delta P$, the pressure $P_2$ at the riser after turning on the downlink device, and the opening area $S_1$ of the throttle valve of the downlink device are calculated to obtain an accurate diversion algorithm of the downlink device.

Then, according to the relationship between the opening degree of the throttle valve and the opening area $S_1$ of the throttle valve, the throttle valve is adjusted to the calculated opening degree, so that the diverting flow automatically reaches the set diversion ratio. The cut-off circuit is provided to each function block of the rotary steering system. Each function block is numbered to form a preset corresponding relationship between the function block and the diverting flow of the downlink device, which is solidified in the rotary steering tool control software. If any function block is abnormal, the diverting flow of the downlink device can be adjusted according to the preset corresponding relationship between the function block and the diverting flow, thereby automatically targeting the function block that needs to be cut off according to a flow change detected downhole. As a result, the downhole unit of the rotary steering system is remotely shut down from the ground, so as to ensure the normal operation of the system.

The beneficial effects of the present invention are mainly as follows:

1. According to the present invention, since the front end of the throttle valve and the riser are the same pressure system, the pressures of the two are the same. Based on the pressure balance and the relationship between flow and pressure, it can be assumed that the diversion ratio of the downlink device is k, the equivalent area of the drill water hole is s, the total discharge of the mud pump is Q, and the pressure of the riser before the downlink device is turned on is P. The pressure difference $P_1$ between the front end and the rear end of the drill water hole, the extension loss $\Delta P$, the pressure $P_2$ at the riser after turning on the downlink device, and the opening area $S_1$ of the throttle valve of the downlink device are calculated to obtain an accurate diversion algorithm of the downlink device. Compared with the prior art, if any function block is abnormal, the diverting flow of the downlink device can be adjusted according to the preset corresponding relationship between the function block and the diverting flow, thereby automatically targeting the function block that needs to be cut off according to a flow change detected downhole, so as to realize self-protection and continuous operation of the entire rotary steering system, reduce frequency of inspection that needs to pull back the drill when the rotary steering system is abnormal, improve drilling efficiency, and reduce costs.

2. According to the present invention, since it is possible to adjust the diverting flow of the downlink device through the preset corresponding relationship between the function block and the diverting flow, when error occurs in a certain function block, that function block can be automatically targeted, and a command to shut down that function block will be issued through the downlink device, thereby avoiding affecting the operation of the whole system due to the error of the certain function block. The pertinence is strong.

3. According to the present invention, since the total mud displacement of the mud pump is constant during the drilling process of one layer section, the change of the mud flow reflects the diverting flow of the downlink device. Therefore, it is possible to represent different commands by the size and duration of the diverting flow, which forms the inherent coding method. The rotary steering system detects the size of the diverting flow downhole, and combines with the inherent coding method to complete the identification of the downlink command, which is easy to operate.

DETAILED DESCRIPTION OF THE PREFERRED EMBODIMENT

Embodiment 1

A method for remotely shutting down a downhole unit of a rotary steering system from ground is provided, comprising steps of:

a: setting a diversion ratio of a downlink device as k, an equivalent area of a drill water hole as s, a total displacement of a mud pump as Q, and a pressure of a riser before the downlink device is turned on as P; calculating a pressure difference $P_1$ between a front end and a rear end of the drill water hole by a formula 1;

$$P_1=Q^2\rho/2\mu^2s^2 \quad \text{formula 1;}$$

wherein Q is the total displacement of the mud pump, $m^2/s$; μ is a flow coefficient and μ=0.63; s is the equivalent area of the drill water hole, $m^2$; $P_1$ is the pressure difference between the front end and the rear end of the drill water hole, Pa; and ρ is fluid density, $Kg/m^2$;

b: calculating an extension loss ΔP by a formula 2;

$$\Delta P=P-P_1 \quad \text{formula 2;}$$

c: calculating a pressure $P_2$ at the riser after turning on the downlink device by a formula 3;

$$P_2=\Delta P+\rho(1-k)^2Q^2/2\mu^2s^2 \quad \text{formula 3;}$$

d: since a pressure drop of a throttle valve of the downlink device is also $P_2$ according to a pressure balance relationship, calculating an opening area $S_1$ of the throttle valve of the downlink device by a formula 4;

$$S_1 = kQ/\sqrt[\mu]{2P_2/\rho}; \quad \text{formula 4}$$

and e: adjusting the throttle valve to a calculated opening degree according to a relationship between the opening degree and the opening area $S_1$ of the throttle valve, so that a diverting flow automatically reaches the set diversion ratio; providing a cut-off circuit to each function block of the rotary steering system; numbering each function block, and forming a preset corresponding relationship between the function block and the diverting flow of the downlink device, which is solidified in a rotary steering tool control software; if any function block is abnormal, adjusting the diverting flow of the downlink device according to the preset corresponding relationship between the function block and the diverting flow; automatically targeting the function block that needs to be cut off according to a flow change detected downhole, and shutting down the downhole unit.

Since the front end of the throttle valve and the riser are the same pressure system, the pressures of the two are the same. Based on the pressure balance and the relationship between flow and pressure, it can be assumed that the diversion ratio of the downlink device is k, the equivalent area of the drill water hole is s, the total discharge of the mud pump is Q, and the pressure of the riser before the downlink device is turned on is P. The pressure difference $P_1$ between the front end and the rear end of the drill water hole, the extension loss ΔP, the pressure $P_2$ at the riser after turning on the downlink device, and the opening area $S_1$ of the throttle valve of the downlink device are calculated to obtain an accurate diversion algorithm of the downlink device. Compared with the prior art, if any function block is abnormal, the diverting flow of the downlink device can be adjusted according to the preset corresponding relationship between the function block and the diverting flow, thereby automatically targeting the function block that needs to be cut off according to a flow change detected downhole, so as to realize self-protection and continuous operation of the entire rotary steering system, reduce frequency of inspection that needs to pull back the drill when the rotary steering system is abnormal, improve drilling efficiency, and reduce costs.

Embodiment 2

A method for remotely shutting down a downhole unit of a rotary steering system from ground is provided, comprising steps of:

a: setting a diversion ratio of a downlink device as k, an equivalent area of a drill water hole as s, a total displacement of a mud pump as Q, and a pressure of a riser before the downlink device is turned on as P; calculating a pressure difference $P_1$ between a front end and a rear end of the drill water hole by a formula 1;

$$P_1=Q^2\rho/2\mu^2s^2 \quad \text{formula 1;}$$

wherein Q is the total displacement of the mud pump, $m^2/s$; μ is a flow coefficient and μ=0.63; s is the equivalent area of the drill water hole, $m^2$; $P_1$ is the pressure difference between the front end and the rear end of the drill water hole, Pa; and ρ is fluid density, $Kg/m^3$;

b: calculating an extension loss ΔP by a formula 2;

$$\Delta P=P-P_1 \quad \text{formula 2;}$$

c: calculating a pressure $P_2$ at the riser after turning on the downlink device by a formula 3;

$$P_2=\Delta P+\rho(1-k)^2Q^2/2\mu^2s^2 \quad \text{formula 3;}$$

d: since a pressure drop of a throttle valve of the downlink device is also $P_2$ according to a pressure balance relationship, calculating an opening area $S_1$ of the throttle valve of the downlink device by a formula 4;

$$S_1 = kQ/\sqrt[\mu]{2P_2/\rho}; \quad \text{formula 4}$$

and e: adjusting the throttle valve to a calculated opening degree according to a relationship between the opening degree and the opening area $S_1$ of the throttle valve, so that a diverting flow automatically reaches the set diversion ratio; providing a cut-off circuit to each function block of the rotary steering system; numbering each function block, and forming a preset corresponding relationship between the function block and the diverting flow of the downlink device, which is solidified in a rotary steering tool control software; if any function block is abnormal, adjusting the diverting flow of the downlink device according to the preset corresponding relationship between the function block and the diverting flow; automatically targeting the function block that needs to be cut off according to a flow change detected downhole, and shutting down the downhole unit.

In the step e, adjusting the throttle valve to the calculated opening degree comprises specific steps of: calibrating indoors to form a relationship curve between the opening degree and the opening area; and obtaining a required opening degree based on the relationship curve between the opening degree and the opening area, as well as a required opening area of the throttle valve area corresponding to the diversion ratio set in the previous step.

Embodiment 3

A method for remotely shutting down a downhole unit of a rotary steering system from ground is provided, comprising steps of:

a: setting a diversion ratio of a downlink device as k, an equivalent area of a drill water hole as s, a total displacement of a mud pump as Q, and a pressure of a riser before the downlink device is turned on as P; calculating a pressure difference $P_1$ between a front end and a rear end of the drill water hole by a formula 1;

$$P_1=Q^2\rho/2\mu^2s^2 \quad \text{formula 1;}$$

wherein Q is the total displacement of the mud pump, $m^2/s$; μ is a flow coefficient and μ=0.63; s is the equivalent area of the drill water hole, $m^2$; $P_1$ is the pressure difference between the front end and the rear end of the drill water hole, Pa; and ρ is fluid density, $Kg/m^2$;

b: calculating an extension loss ΔP by a formula 2;

$$\Delta P=P-P_1 \quad \text{formula 2;}$$

c: calculating a pressure $P_2$ at the riser after turning on the downlink device by a formula 3;

$$P_2=\Delta P+\rho(1-k)^2Q^2/2\mu^2s^2 \quad \text{formula 3;}$$

d: since a pressure drop of a throttle valve of the downlink device is also $P_2$ according to a pressure balance relationship, calculating an opening area $S_1$ of the throttle valve of the downlink device by a formula 4;

$$S_1 = kQ/\sqrt[\mu]{2P_2/\rho}; \quad \text{formula 4}$$

and e: adjusting the throttle valve to a calculated opening degree according to a relationship between the opening degree and the opening area $S_1$ of the throttle valve, so that a diverting flow automatically reaches the set diversion ratio; providing a cut-off circuit to each function block of the rotary steering system; numbering each function block, and forming a preset corresponding relationship between the function block and the diverting flow of the downlink device, which is solidified in a rotary steering tool control software; if any function block is abnormal, adjusting the diverting flow of the downlink device according to the preset corresponding relationship between the function block and the diverting flow; automatically targeting the function block that needs to be cut off according to a flow change detected downhole, and shutting down the downhole unit.

In the step e, adjusting the throttle valve to the calculated opening degree comprises specific steps of: calibrating indoors to form a relationship curve between the opening degree and the opening area; and obtaining a required opening degree based on the relationship curve between the opening degree and the opening area, as well as a required opening area of the throttle valve area corresponding to the diversion ratio set in the previous step.

In the step e, the diverting flow automatically reaches the set diversion ratio through specific steps of: after the downlink device receives the set diversion ratio, calculating a required opening area of the throttle valve of the downlink device according to a calculation formula, and then obtaining a required opening degree of the throttle valve according to the relationship between the opening degree and the opening area $S_1$ of the throttle valve; according to a corresponding relationship between the required opening degree of the throttle valve and an analog electrical signal, outputting a current signal, so as to reach the set diversion ratio through automatic adjustment of the throttle valve of the downlink device.

Since it is possible to adjust the diverting flow of the downlink device through the preset corresponding relationship between the function block and the diverting flow, when error occurs in a certain function block, that function block can be automatically targeted, and a command to shut down that function block will be issued through the downlink device, thereby avoiding affecting the operation of the whole system due to the error of the certain function block. The pertinence is strong.

Embodiment 4

A method for remotely shutting down a downhole unit of a rotary steering system from ground is provided, comprising steps of:

a: setting a diversion ratio of a downlink device as k, an equivalent area of a drill water hole as s, a total displacement of a mud pump as Q, and a pressure of a riser before the downlink device is turned on as P; calculating a pressure difference $P_1$ between a front end and a rear end of the drill water hole by a formula 1;

$$P_1=Q^2\rho/2\mu^2s^2 \quad \text{formula 1;}$$

wherein Q is the total displacement of the mud pump, $m^2/s$; μ is a flow coefficient and μ=0.63; s is the equivalent area of the drill water hole, $m^2$; $P_1$ is the pressure difference between the front end and the rear end of the drill water hole, Pa; and ρ is fluid density, $Kg/m^3$;

b: calculating an extension loss ΔP by a formula 2;

$$\Delta P=P-P_1 \quad \text{formula 2;}$$

c: calculating a pressure $P_2$ at the riser after turning on the downlink device by a formula 3;

$$P_2=\Delta P+\rho(1-k)^2Q^2/2\mu^2s^2 \quad \text{formula 3;}$$

d: since a pressure drop of a throttle valve of the downlink device is also $P_2$ according to a pressure balance relationship, calculating an opening area $S_1$ of the throttle valve of the downlink device by a formula 4;

$$S_1 = kQ/\sqrt[\mu]{2P_2/\rho}; \quad \text{formula 4}$$

and e: adjusting the throttle valve to a calculated opening degree according to a relationship between the opening degree and the opening area $S_1$ of the throttle valve, so that a diverting flow automatically reaches the set diversion ratio; providing a cut-off circuit to each function block of the rotary steering system; numbering each function block, and forming a preset corresponding relationship between the function block and the diverting flow of the downlink device, which is solidified in a rotary steering tool control software; if any function block is abnormal, adjusting the diverting flow of the downlink device according to the preset corresponding relationship between the function block and the diverting flow; automatically targeting the function block that needs to be cut off according to a flow change detected downhole, and shutting down the downhole unit.

In the step e, adjusting the throttle valve to the calculated opening degree comprises specific steps of: calibrating indoors to form a relationship curve between the opening degree and the opening area; and obtaining a required opening degree based on the relationship curve between the opening degree and the opening area, as well as a required opening area of the throttle valve area corresponding to the diversion ratio set in the previous step.

In the step e, the diverting flow automatically reaches the set diversion ratio through specific steps of: after the downlink device receives the set diversion ratio, calculating a required opening area of the throttle valve of the downlink device according to a calculation formula, and then obtaining a required opening degree of the throttle valve according to the relationship between the opening degree and the opening area $S_1$ of the throttle valve; according to a corresponding relationship between the required opening degree of the throttle valve and an analog electrical signal, outputting a current signal, so as to reach the set diversion ratio through automatic adjustment of the throttle valve of the downlink device.

In the step e, forming the preset corresponding relationship between the function block and the diverting flow comprises specific steps of: presetting 9 function blocks, and installing a controllable diode on each of the 9 function blocks; using three flows of 10%, 15% and 20% with different durations to represent the 9 function blocks; wherein the 10% diverting flow lasting for 2 s means to shut down a 1 # function block; the 10% diverting flow lasting for 4 s means to shut down a 2 # function block; the 10% diverting flow lasting for 6 s means to shut down a 3 # function block; the 15% diverting flow lasting for 2 s means to shut down a 4 # function block; the 15% diverting flow lasting for 4 s means to shut down a 5 # function block; the 15% diverting flow lasting for 6 s means to shut down a 6 # function block; the 20% diverting flow lasting for 2 s means to shut down a 7 # function block; the 20% diverting flow lasting for 4 s means to shut down a 8 # function block; and the 20% diverting flow lasting for 6 s means to shut down a 9 # function block.

Embodiment 4

A method for remotely shutting down a downhole unit of a rotary steering system from ground is provided, comprising steps of:

a: setting a diversion ratio of a downlink device as k, an equivalent area of a drill water hole as s, a total displacement of a mud pump as Q, and a pressure of a riser before the downlink device is turned on as P; calculating a pressure difference $P_1$ between a front end and a rear end of the drill water hole by a formula 1;

$$P_1=Q^2\rho/2\mu^2s^2 \quad \text{formula 1;}$$

wherein Q is the total displacement of the mud pump, $m^2/s$; μ is a flow coefficient and μ=0.63; s is the equivalent area of the drill water hole, $m^2$; $P_1$ is the pressure difference between the front end and the rear end of the drill water hole, Pa; and ρ is fluid density, $Kg/m^3$;

b: calculating an extension loss ΔP by a formula 2;

$$\Delta P=P-P_1 \quad \text{formula 2;}$$

c: calculating a pressure $P_2$ at the riser after turning on the downlink device by a formula 3;

$$P_2=\Delta P+\rho(1-k)^2Q^2/2\mu^2s^2 \quad \text{formula 3;}$$

d: since a pressure drop of a throttle valve of the downlink device is also $P_2$ according to a pressure balance relationship, calculating an opening area $S_1$ of the throttle valve of the downlink device by a formula 4;

$$S_1 = kQ/\sqrt[4]{2P_2/\rho}; \quad \text{formula 4}$$

and e: adjusting the throttle valve to a calculated opening degree according to a relationship between the opening degree and the opening area $S_1$ of the throttle valve, so that a diverting flow automatically reaches the set diversion ratio; providing a cut-off circuit to each function block of the rotary steering system; numbering each function block, and forming a preset corresponding relationship between the function block and the diverting flow of the downlink device, which is solidified in a rotary steering tool control software; if any function block is abnormal, adjusting the diverting flow of the downlink device according to the preset corresponding relationship between the function block and the diverting flow; automatically targeting the function block that needs to be cut off according to a flow change detected downhole, and shutting down the downhole unit.

In the step e, adjusting the throttle valve to the calculated opening degree comprises specific steps of: calibrating indoors to form a relationship curve between the opening degree and the opening area; and obtaining a required opening degree based on the relationship curve between the opening degree and the opening area, as well as a required opening area of the throttle valve area corresponding to the diversion ratio set in the previous step.

In the step e, the diverting flow automatically reaches the set diversion ratio through specific steps of: after the downlink device receives the set diversion ratio, calculating a required opening area of the throttle valve of the downlink device according to a calculation formula, and then obtaining a required opening degree of the throttle valve according to the relationship between the opening degree and the opening area $S_1$ of the throttle valve; according to a corresponding relationship between the required opening degree of the throttle valve and an analog electrical signal, outputting a current signal, so as to reach the set diversion ratio through automatic adjustment of the throttle valve of the downlink device.

In the step e, forming the preset corresponding relationship between the function block and the diverting flow comprises specific steps of: presetting 9 function blocks, and installing a controllable diode on each of the 9 function blocks; using three flows of 10%, 15% and 20% with different durations to represent the 9 function blocks; wherein the 10% diverting flow lasting for 2 s means to shut down a 1 # function block; the 10% diverting flow lasting for 4 s means to shut down a 2 # function block; the 10% diverting flow lasting for 6 s means to shut down a 3 # function block; the 15% diverting flow lasting for 2 s means to shut down a 4 # function block; the 15% diverting flow lasting for 4 s means to shut down a 5 # function block; the 15% diverting flow lasting for 6 s means to shut down a 6 # function block; the 20% diverting flow lasting for 2 s means to shut down a 7 # function block; the 20% diverting flow lasting for 4 s means to shut down a 8 # function block; and the 20% diverting flow lasting for 6 s means to shut down a 9 # function block.

In the step e, shutting down the downhole unit comprises specific steps of: since the rotary steering system comprises a downhole mud turbine generator and a voltage frequency changes accordingly when a mud flow through the downhole mud turbine generator changes, detecting a voltage frequency change by a rotary steering control module, so as to obtain a mud flow change; detecting a size of the diverting flow downhole and combining with an inherent coding method to complete identification of a downlink command; after receiving a shutdown command, setting a controllable diode of a corresponding function block to a cut-off state.

Since the total mud displacement of the mud pump is constant during the drilling process of one layer section, the change of the mud flow reflects the diverting flow of the downlink device. Therefore, it is possible to represent different commands by the size and duration of the diverting flow, which forms the inherent coding method. The rotary steering system detects the size of the diverting flow downhole, and combines with the inherent coding method to complete the identification of the downlink command, which is easy to operate.

What is claimed is:

1. A method for remotely shutting down a downhole unit of a rotary steering system from ground, comprising steps of:

a: setting a diversion ratio of a downlink device as k, an equivalent area of a drill water hole as s, a total displacement of a mud pump as Q, and a pressure of a riser before the downlink device is turned on as P; calculating a pressure difference $P_1$ between a front end and a rear end of the drill water hole by a formula 1;

$$P_1=Q^2\rho/2\mu^2s^2 \quad \text{formula 1;}$$

wherein Q is the total displacement of the mud pump, $m^2/s$; μ is a flow coefficient and μ=0.63; s is the equivalent area of the drill water hole, $m^2$; $P_1$ is the pressure difference between the front end and the rear end of the drill water hole, Pa; and ρ is fluid density, $Kg/m^3$;

b: calculating an extension loss ΔP by a formula 2;

$$\Delta P=P-P_1 \quad \text{formula 2;}$$

c: calculating a pressure $P_2$ at the riser after turning on the downlink device by a formula 3;

$$P_2=\Delta P+\rho(1-k)^2Q^2/2\mu^2s^2 \quad \text{formula 3;}$$

d: since a pressure drop of a throttle valve of the downlink device is also $P_2$ according to a pressure balance relationship, calculating an opening area $S_1$ of the throttle valve of the downlink device by a formula 4;

$$S_1 = kQ/\sqrt[\mu]{2P_2/\rho}; \quad \text{formula 4}$$

and e: adjusting the throttle valve to a calculated opening degree according to a relationship between the opening degree and the opening area $S_1$ of the throttle valve, so that a diverting flow automatically reaches the set diversion ratio; providing a cut-off circuit to each function block of the rotary steering system; numbering each function block, and forming a preset corresponding relationship between the function block and the diverting flow of the downlink device, which is solidified in a rotary steering tool control software; if any function block is abnormal, adjusting the diverting flow of the downlink device according to the preset corresponding relationship between the function block and the diverting flow; automatically targeting a function block that needs to be cut off according to a flow change detected downhole, and shutting down the downhole unit.

2. The method for remotely shutting down the downhole unit of the rotary steering system from the ground, as recited in claim 1, wherein in the step e, adjusting the throttle valve to the calculated opening degree comprises specific steps of: calibrating indoors to form a relationship curve between the opening degree and the opening area; and obtaining a required opening degree based on the relationship curve between the opening degree and the opening area, as well as a required opening area of the throttle valve area corresponding to the diversion ratio set in the previous step.

3. The method for remotely shutting down the downhole unit of the rotary steering system from the ground, as recited in claim 2, wherein in the step e, the diverting flow automatically reaches the set diversion ratio through specific steps of: after the downlink device receives the set diversion ratio, calculating a required opening area of the throttle valve of the downlink device according to a calculation formula, and then obtaining a required opening degree of the throttle valve according to the relationship between the opening degree and the opening area $S_1$ of the throttle valve; according to a corresponding relationship between the required opening degree of the throttle valve and an analog electrical signal, outputting a current signal, so as to reach the set diversion ratio through automatic adjustment of the throttle valve of the downlink device.

4. The method for remotely shutting down the downhole unit of the rotary steering system from the ground, as recited in claim 3, wherein in the step e, forming the preset corresponding relationship between the function block and the diverting flow comprises specific steps of: presetting 9 function blocks, and installing a controllable diode on each of the 9 function blocks; using three diverting flows of 10%, 15% and 20% with different durations to represent the 9 function blocks; wherein the 10% diverting flow lasting for 2s means to shut down a 1 #function block; the 10% diverting flow lasting for 4s means to shut down a 2 #function block; the 10% diverting flow lasting for 6s means to shut down a 3 #function block; the 15% diverting flow lasting for 2s means to shut down a 4 #function block; the 15% diverting flow lasting for 4s means to shut down a 5 #function block; the 15% diverting flow lasting for 6s means to shut down a 6 #function block; the 20% diverting flow lasting for 2s means to shut down a 7 #function block; the 20% diverting flow lasting for 4s means to shut down a 8 #function block; and the 20% diverting flow lasting for 6s means to shut down a 9 #function block.

5. The method for remotely shutting down the downhole unit of the rotary steering system from the ground, as recited in claim 3, wherein in the step e, shutting down the downhole unit comprises specific steps of: since the rotary steering system comprises a downhole mud turbine generator and a voltage frequency changes accordingly when a mud flow through the downhole mud turbine generator changes, detecting a voltage frequency change by a rotary steering control module, so as to obtain a mud flow change; detecting a size of the diverting flow downhole and combining with an inherent coding method to complete identification of a downlink command; after receiving a shutdown command, setting a controllable diode of a corresponding function block to a cut-off state.

6. The method for remotely shutting down the downhole unit of the rotary steering system from the ground, as recited in claim 2, wherein in the step e, forming the preset corresponding relationship between the function block and the diverting flow comprises specific steps of: presetting 9 function blocks, and installing a controllable diode on each of the 9 function blocks; using three diverting flows of 10%, 15% and 20% with different durations to represent the 9 function blocks; wherein the 10% diverting flow lasting for 2s means to shut down a 1 #function block; the 10% diverting flow lasting for 4s means to shut down a 2 #function block; the 10% diverting flow lasting for 6s means to shut down a 3 #function block; the 15% diverting flow lasting for 2s means to shut down a 4 #function block; the 15% diverting flow lasting for 4s means to shut down a 5 #function block; the 15% diverting flow lasting for 6s means to shut down a 6 #function block; the 20% diverting flow lasting for 2s means to shut down a 7 #function block; the 20% diverting flow lasting for 4s means to shut down a 8 #function block; and the 20% diverting flow lasting for 6s means to shut down a 9 #function block.

7. The method for remotely shutting down the downhole unit of the rotary steering system from the ground, as recited in claim 2, wherein in the step e, shutting down the downhole unit comprises specific steps of: since the rotary steering system comprises a downhole mud turbine generator and a voltage frequency changes accordingly when a mud flow through the downhole mud turbine generator changes, detecting a voltage frequency change by a rotary steering control module, so as to obtain a mud flow change; detecting a size of the diverting flow downhole and combining with an inherent coding method to complete identification of a downlink command; after receiving a shutdown command, setting a controllable diode of a corresponding function block to a cut-off state.

8. The method for remotely shutting down the downhole unit of the rotary steering system from the ground, as recited in claim 1, wherein in the step e, the diverting flow automatically reaches the set diversion ratio through specific steps of: after the downlink device receives the set diversion ratio, calculating a required opening area of the throttle valve of the downlink device according to a calculation formula, and then obtaining a required opening degree of the throttle valve according to the relationship between the opening degree and the opening area $S_1$ of the throttle valve; according to a corresponding relationship between the required opening degree of the throttle valve and an analog electrical signal, outputting a current signal, so as to reach the set diversion ratio through automatic adjustment of the throttle valve of the downlink device.

9. The method for remotely shutting down the downhole unit of the rotary steering system from the ground, as recited in claim 8, wherein in the step e, forming the preset corresponding relationship between the function block and the diverting flow comprises specific steps of: presetting 9 function blocks, and installing a controllable diode on each of the 9 function blocks; using three diverting flows of 10%, 15% and 20% with different durations to represent the 9 function blocks; wherein the 10% diverting flow lasting for 2s means to shut down a 1 #function block; the 10% diverting flow lasting for 4s means to shut down a 2 #function block; the 10% diverting flow lasting for 6s means to shut down a 3 #function block; the 15% diverting flow lasting for 2s means to shut down a 4 #function block; the 15% diverting flow lasting for 4s means to shut down a 5 #function block; the 15% diverting flow lasting for 6s means to shut down a 6 #function block; the 20% diverting flow lasting for 2s means to shut down a 7 #function block; the 20% diverting flow lasting for 4s means to shut down a 8 #function block; and the 20% diverting flow lasting for 6s means to shut down a 9 #function block.

10. The method for remotely shutting down the downhole unit of the rotary steering system from the ground, as recited in claim 8, wherein in the step e, shutting down the downhole unit comprises specific steps of: since the rotary steering system comprises a downhole mud turbine generator and a voltage frequency changes accordingly when a mud flow through the downhole mud turbine generator changes, detecting a voltage frequency change by a rotary steering control module, so as to obtain a mud flow change; detecting a size of the diverting flow downhole and combining with an inherent coding method to complete identification of a downlink command; after receiving a shutdown command, setting a controllable diode of a corresponding function block to a cut-off state.

11. The method for remotely shutting down the downhole unit of the rotary steering system from the ground, as recited in claim 1, wherein in the step e, forming the preset corresponding relationship between the function block and the diverting flow comprises specific steps of: presetting 9 function blocks, and installing a controllable diode on each of the 9 function blocks; using three diverting flows of 10%, 15% and 20% with different durations to represent the 9 function blocks; wherein the 10% diverting flow lasting for 2s means to shut down a 1 #function block; the 10% diverting flow lasting for 4s means to shut down a 2 #function block; the 10% diverting flow lasting for 6s means to shut down a 3 #function block; the 15% diverting flow lasting for 2s means to shut down a 4 #function block; the 15% diverting flow lasting for 4s means to shut down a 5 #function block; the 15% diverting flow lasting for 6s means to shut down a 6 #function block; the 20% diverting flow lasting for 2s means to shut down a 7 #function block; the 20% diverting flow lasting for 4s means to shut down a 8 #function block; and the 20% diverting flow lasting for 6s means to shut down a 9 #function block.

12. The method for remotely shutting down the downhole unit of the rotary steering system from the ground, as recited in claim 1, wherein in the step e, shutting down the downhole unit comprises specific steps of: since the rotary steering system comprises a downhole mud turbine generator and a voltage frequency changes accordingly when a mud flow through the downhole mud turbine generator changes, detecting a voltage frequency change by a rotary steering control module, so as to obtain a mud flow change; detecting a size of the diverting flow downhole and combining with an inherent coding method to complete identification of a downlink command; after receiving a shutdown command, setting a controllable diode of a corresponding function block to a cut-off state.

13. The method for remotely shutting down the downhole unit of the rotary steering system from the ground, as recited in claim 1, wherein the total displacement of the mud pump is constant during a drilling process of one layer section.

14. The method for remotely shutting down the downhole unit of the rotary steering system from the ground, as recited in claim 1, wherein a mud flow change reflects the diverting flow of the downlink device.

* * * * *